United States Patent [19]

Lai

[11] Patent Number: 4,616,680

[45] Date of Patent: Oct. 14, 1986

[54] CATCH-CORD DRAWING DEVICE FOR LOOMS

[75] Inventor: Pepper Y. Lai, Greensboro, N.C.

[73] Assignee: Draper Corporation, Greensboro, N.C.

[21] Appl. No.: 618,664

[22] Filed: Jun. 8, 1984

[51] Int. Cl.[4] ..... D03D 49/20

[52] U.S. Cl. ..... 139/304; 139/302; 139/311

[58] Field of Search ..... 139/291 C, 302, 303, 139/304, 309, 194, 429, 311

[56] References Cited

U.S. PATENT DOCUMENTS 2,389,809 11/1945 Moessinger ..... 139/302
3,200,852 8/1965 Koyder ..... 139/304
3,461,920 8/1969 Sakamoto ..... 139/302
4,171,008 10/1979 Onishi et al. ..... 139/302

*Primary Examiner*—Henry S. Jaudon
*Attorney, Agent, or Firm*—Charles R. Rhodes; Judith E. Garmon

[57] ABSTRACT

The catch-cord selvage of a shuttleless or fluid jet loom is drawn between a pair of mating rollers having smooth surfaces under a prescribed tension that is matched to the fabric tension as it comes from the loom. The mating rollers include an idler roller which is driven by a drive roller, with the drive roller being positively driven without slippage by the fabric take-up roll. The surface speed of the drive roller is the same as the surface speed of the fabric take-up roll so that the catch-cord and the fabric are drawn from the loom at the same speed.

3 Claims, 2 Drawing Figures

FIG. 2
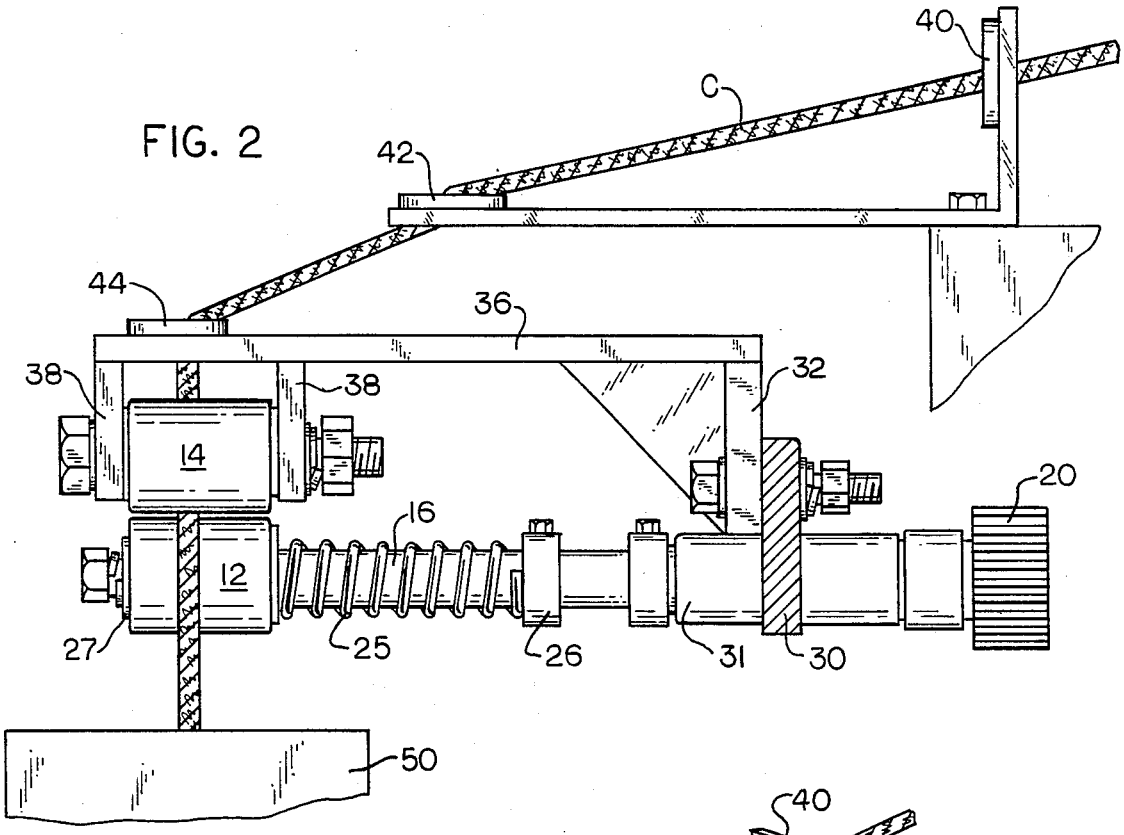
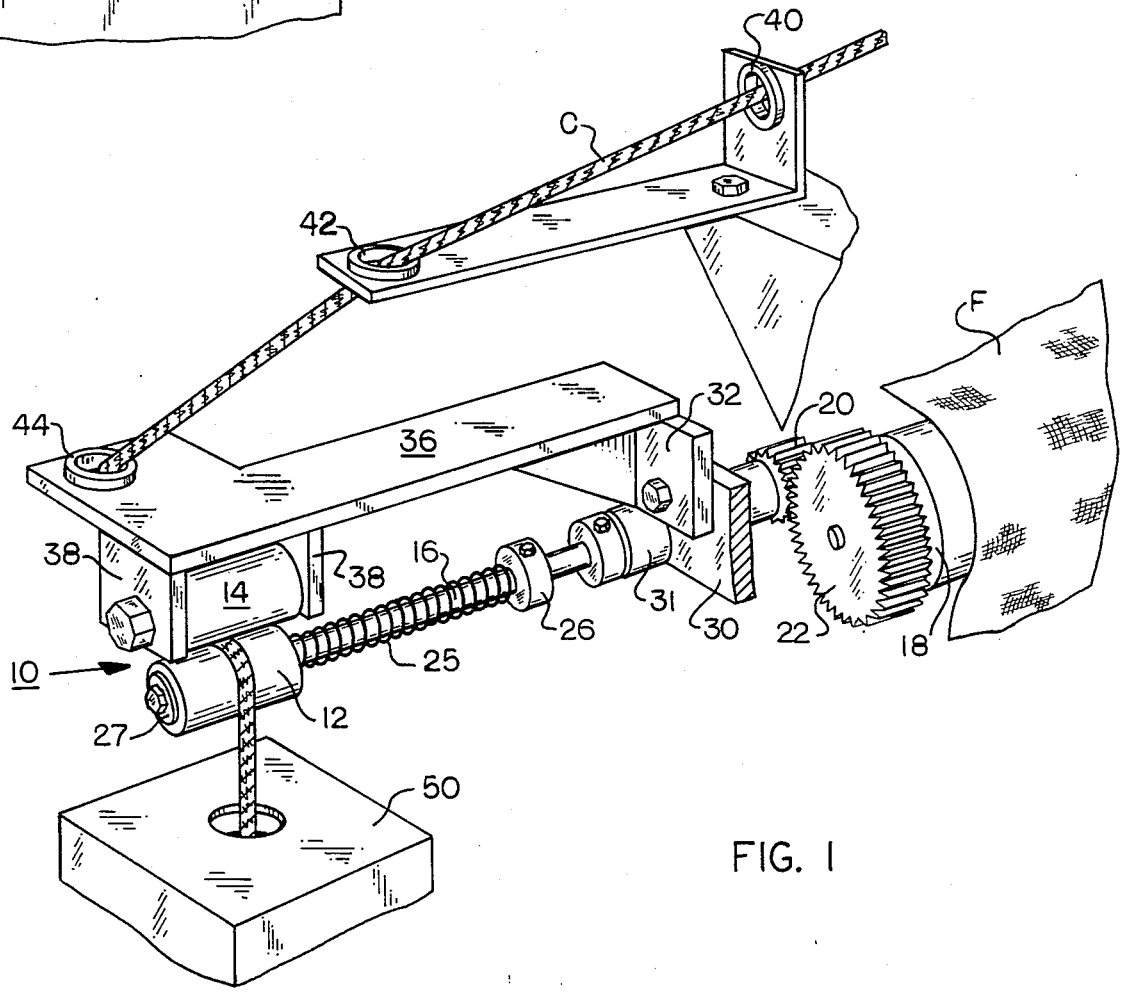
FIG. 1

CATCH-CORD DRAWING DEVICE FOR LOOMS

BACKGROUND AND SUMMARY OF THE PRESENT INVENTION

In the conventional weaving of fabric on a shuttleless loom or a fluid jet loom, a weft yarn is repeatedly inserted from one side of the woven cloth to the other, the inserting motion being known as a picking motion. One or both ends of the inserted weft yarn are then cut by a cutting device and the opposite side ends of the weft yarn are left hanging out of the selvage portion of the woven cloth. Such hanging yarn ends may frequently be reinserted during a subsequent pick into the structure of the woven cloth, with the result being a faulty pick and/or a damaged selvage.

A known technique for preventing such problems is to provide an additional selvage (known as a catch-cord or waste binding yarn) alongside the existing selvage of the woven cloth, which additional selvage is utilized for grasping and holding the severed ends of the inserted weft threads. The inserted wefts are cut at the intervening portion between the cloth selvage and the additional selvage, and after trimming and twisting of this additional selvage the catch-cord is pulled or drawn off the loom and collected in a waste receptacle. The catch-cords are either discarded, or in some instances used for making novelty fabrics.

The catch-cords should be drawn from the loom under the same tension and thus the same speed as the woven fabric as it is taken off the loom by the take-off roll. Prior art means for drawing the catch-cords is to mount a pair of cooperating rotatable spur gears on the loom, between which gears the catch-cord is nipped and drawn by a rotation thereof at a speed greater than the fabric take-up roll. Such a structure has created problems related both to: (1) maintaining a proper tension on the catch-cord; and (2) preventing the entanglement of the catch-cord in the drawing gears. With the advent of looms of higher speeds these problems are amplified. With regard to maintaining a proper tension on the catch-cord, if the tension in the drawing rate of the catch-cord is not properly controlled, it may lead to imperfections in the fabric, to faulty cutting of the selvages on the fabric, and/or the breaking of the catch-cord. Improper tension control is frequently caused by the connecting means (generally a balt) between drive shaft for the take-up gears and the pulleys fabric take-up mechanism. Most known structures include a complex arrangement of gears, pulleys, belts, and/or sproket chains which connect the drive shaft for the catch-cord take-up roll to the loom drive. Further, intentionally turning the drive roll faster than the take-up roll causes greater, and thus undesirable, tension in the catch-cord.

The problems with respect to entanglement of the catch-cord in the take-up gears is obvious. Entanglement will cause a variation in tension on the catch-cord and result in imperfections in the fabric and/or jam the take-up gears such that the catch-cord is not pulled off at all. Such problems not only may result in imperfections in the fabric, but in costly down time and repair time for equipment.

The present invention is directed to a highly improved means for drawing the catch-cord selvage from a shuttleless or particularly a fluid jet loom. The improved catch-cord drawing device comprises a pair of smooth surface, cooperating roller members which draw the catch-cord therethrough under the same tension as is applied to the fabric. The cooperating roller members comprise an idler roll and a drive roller which is driven by a shaft that is in turn positively driven by the fabric take-up roll on the loom that applies tension to the fabric for pulling it off the loom. A simple arrangement of meshing gears operatively connects the rotating fabric take-up mechanism to the shaft that drives the catch-cord drive roller. The gear ratios are such that the surface speed of the drive roller is the same as the surface speed of the fabric take-up roll. This arrangement is preferred over the previously known arrangement of driving the drive roller at a speed greater than the fabric take-up roll. The smooth rollers obviously will prevent the type of entanglement that was a common occurrence when spur gears were used.

The surface speed of the drive roller is synchronized to be the same as the speed of the fabric take-up roll such that the catch-cord is drawn from the loom at the same speed as the fabric. This arrangement, as opposed to prior devices which run the catch-cord take-up at a speed slightly faster than that of the fabric, matches the tension on the catch-cord with that of the fabric which aids in the trimming of the catch-cord selvage and substantially eliminates imperfections resulting from improper tension on the catch-cord. In order to make adjustments in the speed of the drive roller and the tension on the catch-cord, the drive roller is mounted on its shaft by means of a slip-fit mechanism. This slip-fit mechanism allows the roller, which fits relatively loosely on its mounting shaft, to be tightened to run at the same speed as the shaft or slightly slower.

The objectives of the present invention therefore include a significantly improved catch-cord drawing device, the speed of which is synchronized to the speed of the fabric being taken off the loom. Other and further objectives and improvements in the present invention will become obvious as the following detailed description is studied in conjunction with the accompanying drawings of which:

FIG. 1 is a perspective view of the catch-cord drawing device, according to the present invention.

FIG. 2 is a front view of the catch-cord device of FIG. 1.

DETAILED DESCRIPTION OF A PREFERRED EMBODIMENT

The catch-cord drawing device 10 of the present invention shown in FIGS. 1 and 2 is generally comprised of a pair of rotating members including a drive roll 12 and an idler roll 14. The drive roll is propelled by a rotating shaft 16 which is operatively connected to the fabric take-up roll 18 on the shuttleless or fluid jet loom (not shown).

The shaft 16 is operatively connected to the fabric take-up roll 18 by means of a simple gear arrangement comprising meshing gears 20 and 22 as the fabric take-up roll 18 rotates. The gear ratios are so related that the surface speed of drive roll 12 is substantially the same as the surface speed of the take-up roll 18. As the fabric take-up roll 18 rotates to draw the fabric off the loom, the rotation thereof is transmitted to shaft 16 by means of the intermeshing gears 20,22. Thus arranged there is no means for inadvertent slippage between the fabric take-up roll 18 and the shaft 16.

It has been found necessary to be able to move drive roller 12 relative to shaft 16 for two reasons. First in order to catch a new end of catch-cord C between rollers 12,14 and initially apply the same tension to the catch-cord as is applied to the fabric F, roller 12 must move while the loom (with take-up roll 18) is stopped. Secondly, since the diameter of take-up rolls may vary, there may be a need to make fine adjustments in the speed of drive roller 12 so that it remains equal to the surface speed of take-up roll 18. Toward this end the diameter of the opening in drive roll 12 is just slightly greater than the diameter of shaft 16. Then a compression spring 25, which surrounds shaft 16 and is adjustably held in place thereon by collar 26, applies pressure against roll 12 and squeezes it between spring 25 and washer 27. Thus the roll 12 can be manually rotated by an operator who can overcome the spring pressure to cause roll 12 to turn even though the loom is stopped. Also, by adjusting the compressive force of spring 25 against roll 12 and washer 27, fine adjustments in speed or tension discrepancies can be effected.

The take-up rollers 12 and 14 are preferably formed from a very hard polymer material with a smooth drawing surface thereon to prevent entanglement of the catch-cord.

As is best shown in FIG. 1, but is equally clear from FIG. 2, the mechanism for mounting the catch-cord drawing device or retrofitting it on existing looms is quite simple. The shaft 16 is connected to the existing take-up roll 18 as previously described. The support means for the shaft 16 comprises a bracket or bar 30 through which the rotating shaft is mounted in bearing 31. This bar 30 is mounted to a surface of the loom (not shown) in such a way that it extends generally parallel to the outside wall or surface area of the loom. Adjacent and above the shaft 16 is a second bar or bracket 32 mounted parallel to support means 30. This bar 32 supports a bracket 36 that extends perpendicularly thereto, and which includes a downwardly depending means for mounting the idler roll. This mounting means comprises a pair of spaced supports 38 between which the idler roll 14 is rotatably mounted.

As the catch-cord C is drawn from the loom it is guided into the take-up rolls by eyelets 40,42 and 44. As it comes out of the take-up rolls it is deposited in a waste container 50 or if desired may be taken on a winding mechanism for later use as waste material.

Although this mounting means has been described as the type preferably used in retrofitting, it would also be suitable for installation on new machines with little or no modification. The catch-cord device additionally is suitable for virtually any type of loom and is as described substantially less complex than known devices. Of course modifications will become apparent but such modifications are considered to be within the scope of the claims below.

What is claimed is:

1. A catch-cord selvage drawing device for use on fluid jet or shuttleless looms of the type wherein the woven fabric is taken off the loom under tension applied by a take-up roll, and wherein a plurality of catch yarns are introduced alongside the fabric sheet and adjacent one selvage thereof to catch and retain the cut ends of inserted weft yarns to form a "catch-cord selvage" thereof; said winding device being for the purpose of removing such catch-cord selvage and comprising:

(a) a pair of cooperating rotating members for nipping said catch-cord therebetween and drawing therethrough; said pair of rotating members including an idler roller and a drive roller; said idler roller and drive roller including smooth outer surfaces for preventing entanglement of the catch-cord as it is being drawn therebetween;

(b) synchronizing means for connecting said drive roller to the fabric take-up mechanism so that the surface speed of said drive roller is the same as the speed of the fabric as the fabric is removed from the loom onto the take-up roll;

(c) said synchronizing means comprising:

(i) a rotating shaft and means for mounting said drive roller thereon;

(ii) a plurality of meshing, interacting gears connecting said rotating shaft and said take-up roll;

(iii) said drive roller being mounted on one end of said rotating shaft in operative relationship with said idler roller; the surface diameter of said drive roller and the gear ratios of said gears being such that the tension on the catch-cord is substantially the same as the tension on the fabric;

whereby the matching of the speeds of the catch-cord drawing device and the fabric take-up roll results in the same tension upon the selvage ends as is on the fabric.

2. A catch-cord device according to claim 1 wherein said means for mounting said drive roller on said shaft comprises:

(a) said drive roller having an opening therethrough with a diameter slightly greater than the outer diameter of said rotating shaft resulting in a slip fit therebetween;

(b) a stop means fixed with respect to and at one end of said shaft for retaining said drive roller on said rotating shaft;

(c) spring biasing means associated with said shaft and pressing axially against said drive roller to urge said drive roller into engagement with said stop means;

(d) whereby said roller is manually rotatable with respect to said shaft at times when said biasing means is overcome, but said biasing means normally causes said roller to rotate at substantially the same speed as said shaft.

3. A catch-cord device according to claim 2 and further including a means for adjusting the pressure of said spring biasing means against said drive roller whereby said drive roller may be made to lag behind the rotation of said shaft to adjust the surface speed of said drive roller.

* * * * *